US007474057B2

(12) United States Patent
Tambinl et al.

(10) Patent No.: US 7,474,057 B2
(45) Date of Patent: Jan. 6, 2009

(54) HIGH MERCURY DENSITY CERAMIC METAL HALIDE LAMP

(75) Inventors: Antony John Tambinl, Loughborough (GB); Matthew Bugenske, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/289,245

(22) Filed: Nov. 29, 2005

(65) Prior Publication Data

US 2007/0120493 A1 May 31, 2007

(51) Int. Cl.
*H01J 17/20* (2006.01)

(52) U.S. Cl. ..... 313/639; 313/641; 313/571

(58) Field of Classification Search ..... 313/639, 313/634, 150, 163, 637, 546, 580, 595
See application file for complete search history.

(56) References Cited

U.S. PATENT DOCUMENTS 4,348,615 A * 9/1982 Garrison et al. ..... 315/219
5,828,185 A 10/1998 Fellows et al.
5,923,127 A * 7/1999 Keijser et al. ..... 315/224
5,973,453 A 10/1999 Van Vliet et al.
6,111,359 A 8/2000 Work et al.
6,137,229 A 10/2000 Nishiura et al.
6,137,230 A 10/2000 Born et al.
6,163,115 A 12/2000 Ishizuka
6,172,462 B1 1/2001 Gibson et al.
6,215,254 B1 4/2001 Honda et al.
6,222,320 B1 4/2001 Stockwald
6,285,130 B1 9/2001 Nakagawa et al.
6,288,491 B1 9/2001 Ramaiah et al.
6,294,870 B1 9/2001 Kawashima et al.
6,294,871 B1 9/2001 Scott et al.
6,342,764 B1 1/2002 Nishiura et al.
6,356,016 B1 3/2002 Suijker et al.
6,368,175 B1 4/2002 Horiuchi et al.
6,369,522 B1 4/2002 Collins
6,528,946 B2 * 3/2003 Ishigami et al. ..... 313/637
6,614,187 B1 9/2003 Kanzaki et al.
6,762,559 B1 7/2004 Ishikawa et al.
6,798,139 B2 * 9/2004 Ramaiah et al. ..... 313/634
6,919,686 B2 * 7/2005 Okamoto et al. ..... 313/594
7,122,960 B2 * 10/2006 Tukamoto et al. ..... 313/576
2003/0102808 A1 * 6/2003 Dakin et al. ..... 313/640
2003/0173902 A1 9/2003 Venkataramani et al.
2003/0214234 A1 * 11/2003 Fukushima ..... 313/571
2004/0095069 A1 * 5/2004 Yamashita et al. ..... 313/594

(Continued)

FOREIGN PATENT DOCUMENTS

EP 0 215 524 A1 3/1987

(Continued)

*Primary Examiner*—Joseph L Williams
(74) *Attorney, Agent, or Firm*—Fay Sharpe LLP

(57) ABSTRACT

A low wattage mercury vapor lamp comprises a discharge vessel (10) including a tubular body (12), first and second electrodes (20, 22) and two end walls (16, 18), which close opposite ends of the tubular body. The discharge vessel contains an ionizable fill material having a concentration of mercury of from 0.10 to 0.20 mg/mm$^3$. The discharge vessel operates at elevated pressures of from 80 to 170 atmospheres at power of 20 watts resulting in improved lumen maintenance and reduced through-life color shift.

16 Claims, 6 Drawing Sheets

U.S. PATENT DOCUMENTS

| | | | | |
|---|---|---|---|---|
| 2005/0127841 | A1* | 6/2005 | Maseki et al. | 313/637 |
| 2006/0007410 | A1* | 1/2006 | Masuoka et al. | 353/99 |
| 2006/0022596 | A1* | 2/2006 | Watanabe et al. | 313/623 |
| 2006/0164017 | A1* | 7/2006 | Rintamaki et al. | 313/640 |

FOREIGN PATENT DOCUMENTS

| | | | |
|---|---|---|---|
| EP | 0 286 247 | B1 | 10/1988 |
| EP | 0 869 540 | A1 | 10/1998 |
| EP | 0 954 011 | A1 | 3/1999 |
| EP | 1 225 614 | A1 | 7/2002 |
| EP | 1 289 001 | A2 | 3/2003 |
| WO | WO 2004/081963 | | 9/2004 |
| WO | WO 2006/046175 | A2 | 5/2006 |
| WO | WO 2006/078632 | A1 | 7/2006 |

* cited by examiner

HIGH MERCURY DENSITY CERAMIC METAL HALIDE LAMP

FIELD OF INVENTION

The present invention relates to ceramic metal halide lamps and discharge tubes. More particularly, the present invention relates to a high pressure, high mercury density ceramic metal halide discharge lamp that does not suffer from light output intensity lowering or large color shifts as the lamp ages.

BACKGROUND OF THE INVENTION

Discharge lamps produce light by ionizing a fill material, such as a mixture of metal halide and mercury in an inert gas, such as argon, with an arc passing between two electrodes. The electrodes and the fill material are sealed within a translucent or transparent discharge vessel or discharge tube, which maintains the pressure of the energized fill material and allows the emitted light to pass through. The fill material, also known as a "dose," emits a desired spectral energy distribution in response to being excited by the electric arc. For example, halides provide spectral energy distributions that offer a broad choice of light properties, including color temperatures, color rendering, and luminous efficiency.

Discharge tube chambers composed of fused silica "quartz" are readily formed. However, the lifetime of such lamps is often limited by the loss of the metal portion of the metal halide fill (typically sodium) during lamp operation. Sodium ions diffuse through, or react with, the fused silica discharge tube, resulting in a corresponding build-up of free halogen in the discharge tube. Quartz discharge tubes are relatively porous to sodium ions. During lamp operation, sodium passes from the hot plasma and through the discharge tube wall to the cooler region between the discharge tube and the outer jacket or envelope. The lost sodium is thus unavailable to the discharge and can no longer contribute its characteristic emission. The light output consequently diminishes and the color shifts from white toward blue. The arc becomes constricted and, particularly in a horizontally operated lamp, may bow against the discharge tube wall and soften it. Also, loss of sodium causes the operating voltage of the lamp to increase and it may rise to the point where the arc can no longer be sustained, ending the life of the lamp.

Ceramic discharge lamp chambers were developed to operate at higher temperatures than quartz, i.e., above 950° C., for improved color temperature, color rendering, and luminous efficacies, while significantly reducing reaction with the fill material. U.S. Pat. Nos. 5,424,609; 5,698,984; and 5,751,111 provide examples of such discharge tubes. While quartz discharge tubes are limited to operating temperatures of around 950° C. to 1000° C., due to reaction of the halide fill with the quartz, ceramic alumina discharge tubes are able capable of withstanding operating temperatures of 1000° C. to 1250° C. or higher. The higher operating temperatures provide better color rendering and high lamp efficiencies. Ceramic discharge tubes are less porous to sodium ions than quartz tubes and thus retain the metal within the lamp. Various techniques are available for fabricating the discharge tubes, including casting, forging, machining, and various powder processing methods, such as powder injection molding (PIM). In powder processing, a ceramic powder, such as alumina, is supported by a carrier fluid, such as a water-based solution, mixture of organic liquids, or molten polymers. The mixture can be made to emulate a liquid, a plastic, or a rigid solid, by controlling the type and amount of carrier and the ambient conditions (e.g., temperature).

The use of ceramic in high wattage metal halide lamps has improved the useful life and performance of such lamps. Nevertheless, ceramic metal halide lamps still suffer from progressively poorer light output (lumen maintenance) and color shift as the lamp ages and wattage is decreased. This makes it very difficult to manufacture a practical low wattage metal halide lamp having suitable performance.

In addition, typical low wattage ceramic metal halide lamps offer only marginal performance. For example, most 20 watt lamps suffer from such poor light output that their use in most commercial and personal applications are severely limited.

Thus, a need exists for a low wattage ceramic metal halide lamp that provides acceptable performance and lumen maintenance and exhibits minimal through-life color shift.

SUMMARY OF THE INVENTION

In an exemplary embodiment of the present invention, a metal halide lamp is provided. The metal halide lamp includes a discharge vessel, an outer lamp envelope enclosing the discharge vessel, a pair of electrodes sealed in opposing ends of the discharge vessel, and an ionizable fill contained in said discharge vessel. The ionizable fill comprises mercury in a concentration of from 0.11 to 0.20 mg/mm$^3$.

In another exemplary embodiment of the present invention, a discharge vessel is provided. The discharge vessel includes a tubular body of a translucent ceramic material, first and second end walls closing opposite ends of the tubular body to define a discharge space, first and second projecting tubes attached to the first and second end walls, respectively, and extending away from the tubular body, an ionizable fill contained in the tubular body for creating a discharge, the ionizable fill comprising mercury in a concentration of from about 0.11 mg/mm$^3$ to 0.20 mg/mm$^3$, first and second electrodes supported in the chamber, the first electrode extending through and sealed in said first projection tube, said second main electrode extending through and sealed in said second projection tube.

One advantage of at least one embodiment of the present invention is that a ceramic metal vapor lamp is provided which maintains superior lumen maintenance compared to conventional ceramic metal halide lamps.

Another advantage of at least one embodiment of the present invention is the provision of a high efficiency, low wattage ceramic metal halide lamp suitable for use in retail, office and architectural lighting applications.

Still further advantages of the present invention will become apparent to those of ordinary skill in the art upon reading and understanding the following detailed description of the preferred embodiments.

DETAILED DESCRIPTION OF THE INVENTION

Figure 1:
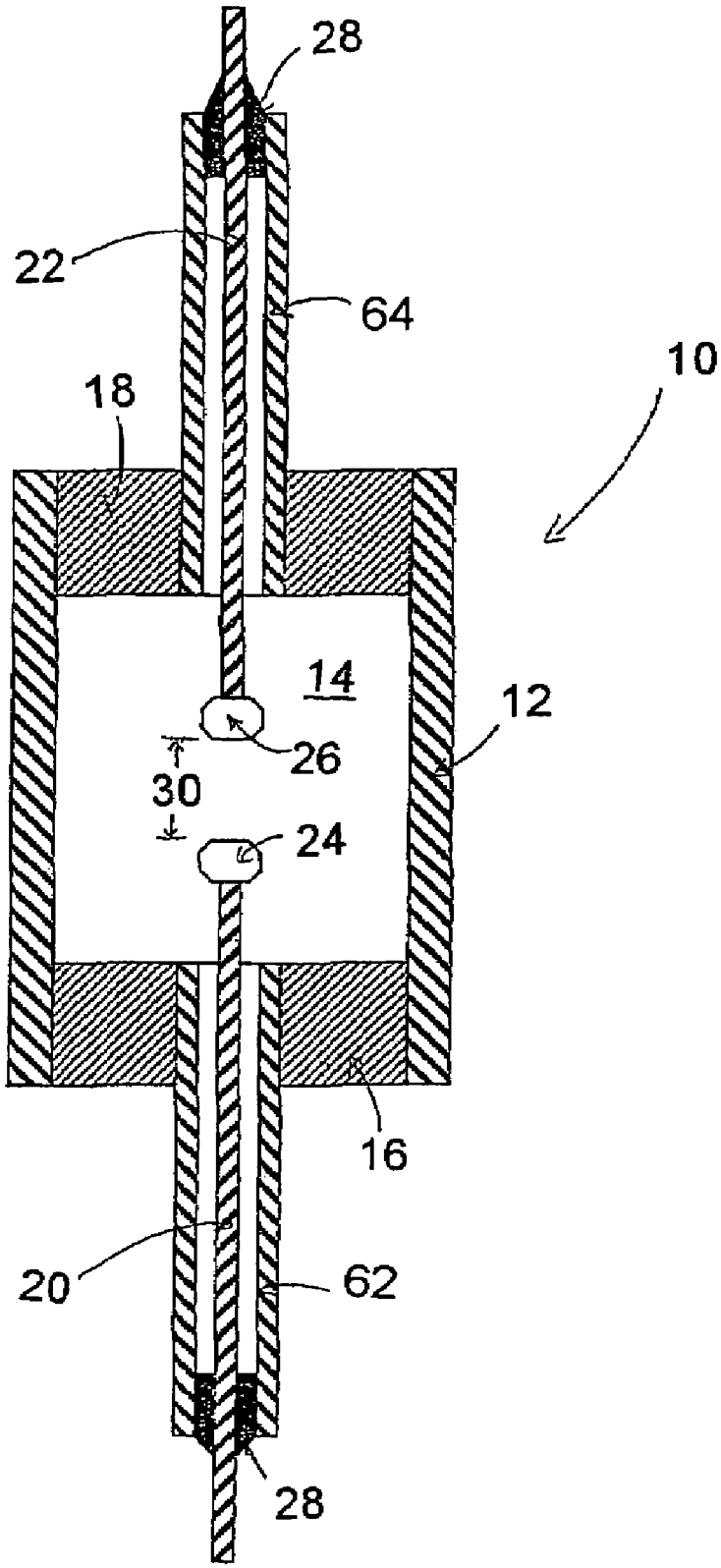
FIG. 1 is a cross-sectional view of a discharge vessel according to one embodiment of the present invention.

With reference to FIG. 1, a ceramic metal halide discharge vessel or discharge tube 10 in accordance with one embodiment of the present invention is shown. The discharge tube 10 comprises a tubular body 12 of translucent refractory material which encloses a discharge space 14 containing an ionizable fill material. First and second end walls 16, 18 made from the same material as the tubular body enclose opposite ends of the body 12. Two electrodes 20, 22 having their tips 24, 26 separated by a distance 30 are arranged in the discharge space 14. The electrodes 20, 22 project through respective end walls 16, 18 and through projecting tubes 62, 64 attached to the end walls. The electrodes are sealed in the projecting tubes using a halide resistant melting ceramic or glass joint 28 to create a gas tight discharge space 14.

Figure 2A:
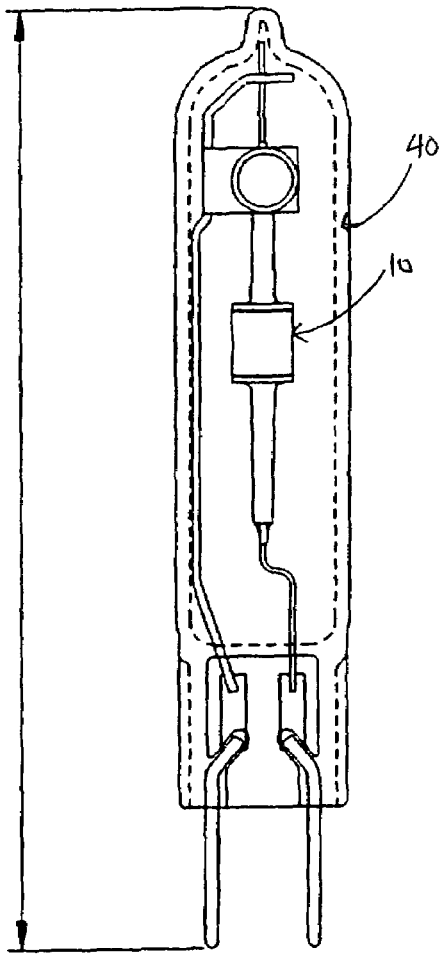
FIGS. 2A and 2B are examples of lamp capsules utilizing the discharge vessel of FIG. 1.
Figure 2B:
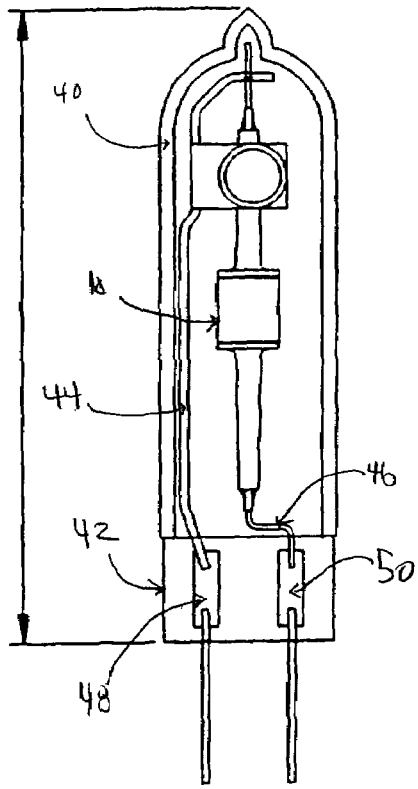

The discharge space 14 contains a fill of an ionizable gas mixture such as metal halide and inert gas mixture. Suitable metal halide fills include at least one metal halide, such as sodium iodide, thalium iodide, or dysprosium iodide, in addition to mercury and a rare gas, such as Argon or Xenon. Other suitable fills for initiating and sustaining an arc discharge known in the art are also contemplated. With reference to FIGS. 2A and 2B, the discharge vessel 10 is enclosed in an outer envelope 40 of glass or other suitable transparent or translucent material, which is closed by a lamp cap 42 at one end.

The two electrodes 20, 22, which may be formed from tungsten, extend into the discharge space 14 and have their tips 24, 26 separated by an arc gap 30. With further reference to FIGS. 2A and 2B, the discharge tube 10 may be mounted in a variety of ways, typically a "mini" lamp capsule such as shown in FIG. 2B having a total capsule length of about 57 millimeters, or a similar "conventional" design lamp capsule having a typical length of about 85 millimeters. In both designs, the electrodes 20, 22 are connected to conductors 44, 46, preferably formed from molybdenum and niobium sections. The connectors electrically connect the electrodes to a power supply (not shown) by first and second electrical contact forming parts 48, 50 of the cap 42. The present discharge tubes and lamps may be operated with commercially available electronic ballasts typically operating at 150-170 Hz square wave.

It will be appreciated that other known electrode materials may alternatively be used. The electrodes 20, 22 are spaced by a gap 30 of about 2-3millimeters. A discharge forms between the tips of the electrodes 24, 26 when a voltage is applied across the electrodes. The lamp outer jacket 40 may be either a vacuum or gas filled.

Figure 3:
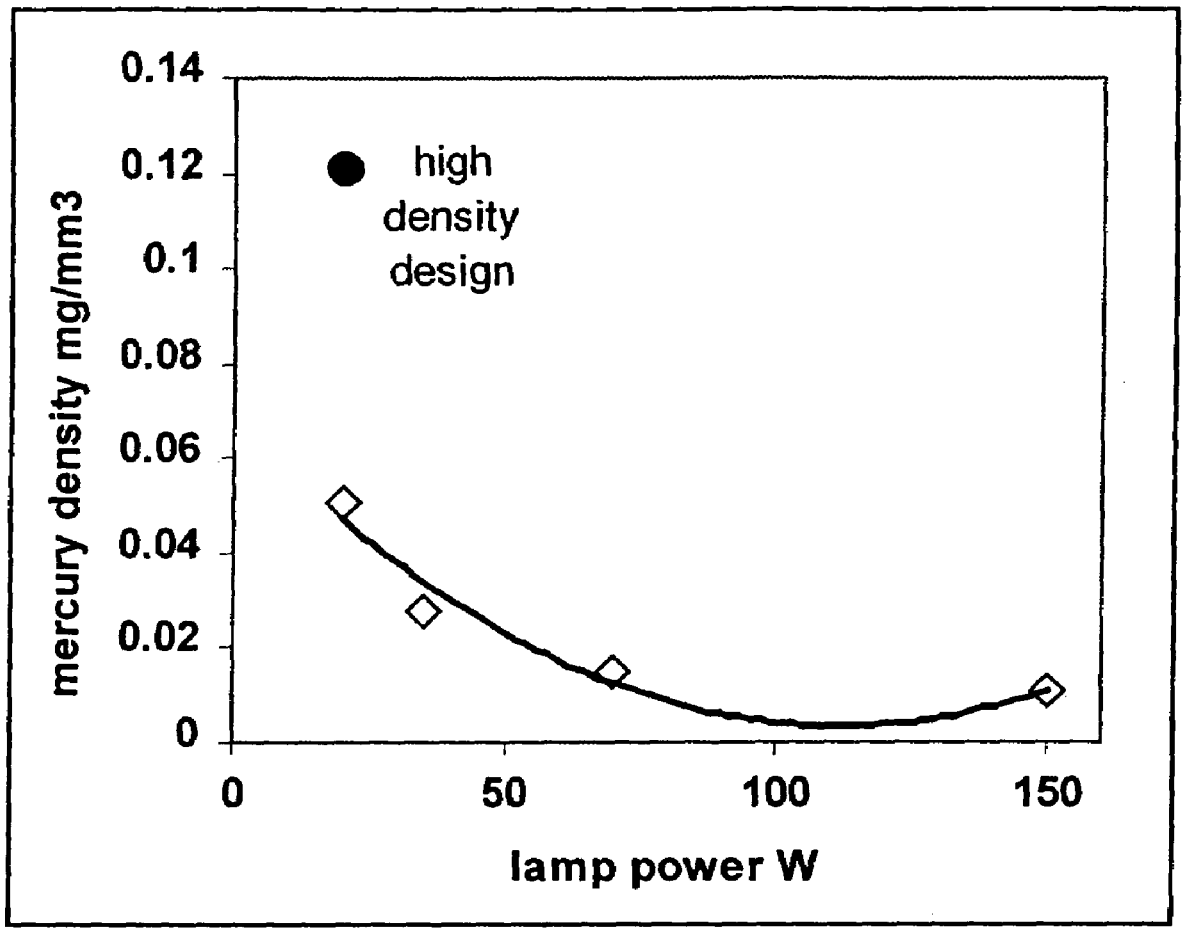
FIG. 3 is a graph of the typical mercury density in a discharge vessel as a function of lamp power in conventional mercury halide lamp compared to the mercury density in a lamp according to the present invention.

The design of the present discharge tube provides a much higher mercury density than found in conventional metal halide lamps. As can be seen in FIG. 3, the mercury density in ceramic metal halide lamps generally increases as lamp wattage decreases, typically from about 0.01 mg/mm3 for a 150 watt lamp to about 0.05 mg/mm3 for a 20 watt lamp. The present invention discharge tube, on the other hand, has a mercury density of from about least 0.10 to about 0.20 mg/mm3, preferably from about 0.11 to 0.14 mg/mm3 and most preferably about 0.12 mg/mm3.

A further characteristic of the present design is that the discharge tube operates at a much higher internal pressure than conventional discharge tubes. The discharge tube in one embodiment of the present invention operates at a pressure of from about 80 to about 170 atmospheres (assuming an average discharge tube temperature of 2000 K), preferably about 100 atmospheres. This is far in excess of the operating pressure of typical metal halide lamps, which range from about 9 atmospheres for a 150-watt lamp to about 23 atmospheres for a 35-watt lamp.

Another characteristic of a discharge tube according to one embodiment of the present invention is that the lamp voltage is increased from a typical value of 90 volts to about 120 volts. In order to accommodate the higher mercury density at this voltage, the arc gap may be made shorter than is conventional in typical discharge tubes. This improves the light gathering capability of the lamp and allows smaller, more efficient reflectors to be used in the fixtures.

Figure 4:
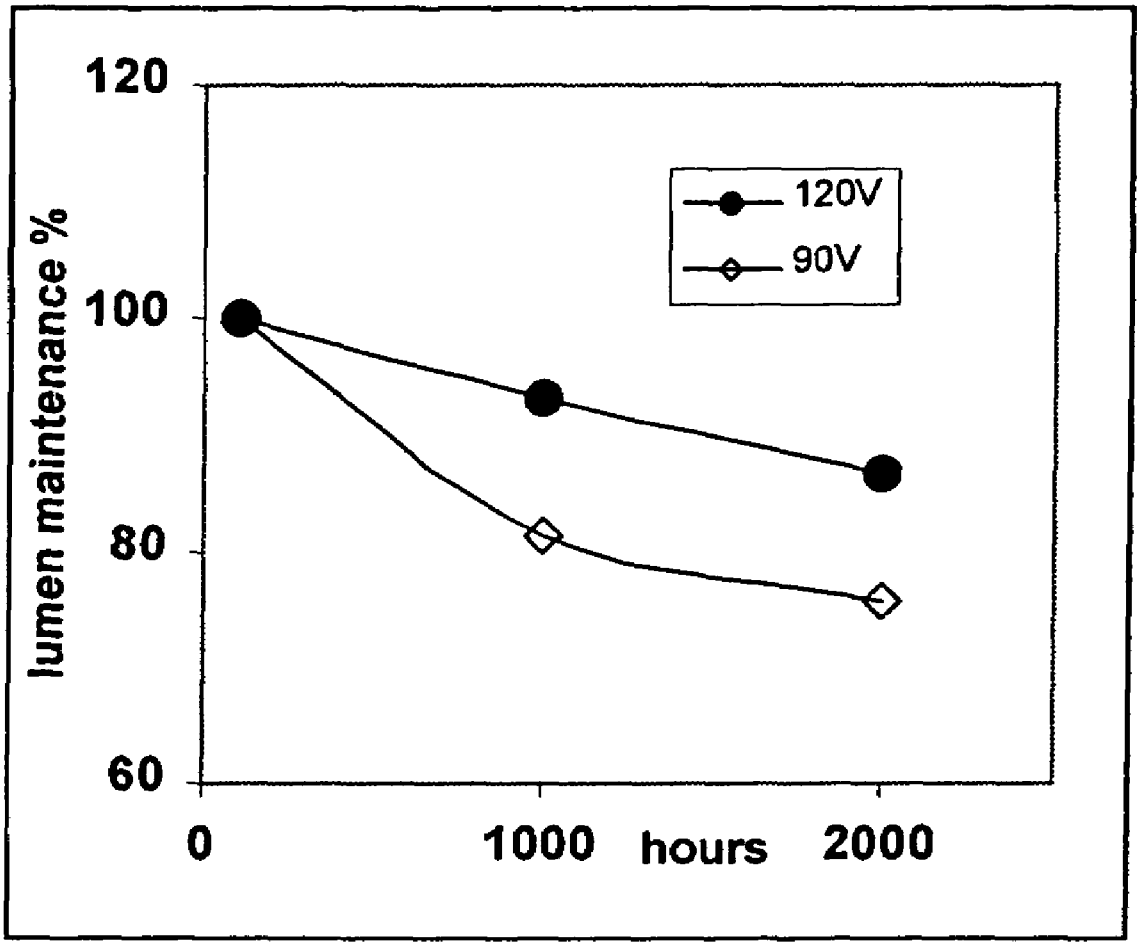
FIG. 4 is a graph comparing the through-life lumen maintenance for a conventional mercury halide lamp compared to a lamp according to the present invention.

With reference to FIG. 4, the lumen maintenance of a 20 watt lamp according to the present invention operating at 120 volts was compared to a conventional 20 watt lamp operating at 90 volts, both aged on continuous burn. It can be seen that the lumen maintenance of the present invention discharge tube was significantly superior, remaining at about 90% after 2000 hours while a conventional lamp was under 80%.

In one embodiment of the present invention, a typical discharge tube has the following dimensions and characteristics.

Inner bulb length: 4.8-5.3 mm
Inner bulb diameter: 3.8-4.2 mm
Arc gap: 2.8-3.0 mm
Mercury weight: 4.2-8.2 mg
Mercury density: 0.10-0.20 mg/mm3
Operating pressure: 80-170 atmospheres The higher mercury density, higher pressure discharge tubes of the present invention offer significant performance benefits than current ceramic metal halide lamps. They offer improved lumen maintenance and reduced through-life color shift over comparable lower mercury density designs of the same lamp wattage. The present lamps find use as low energy alternatives to low voltage halogen display lamps in retail, office, stage/studio, and architectural lighting applications.

The ceramic discharge tube may be formed from a single component or from multiple components. In a first embodiment, the discharge tube 10 is assembled from separate components. In the discharge tube of FIG. 1, there are five main components, the two end walls 16, 18, the tubular body 12, and the two projecting tubes 62, 64. Alternately, as shown in FIG. 5, the end walls and the projecting tubes may be formed as single components as combined end wall/projecting tubes 70, 72.

Figure 5:
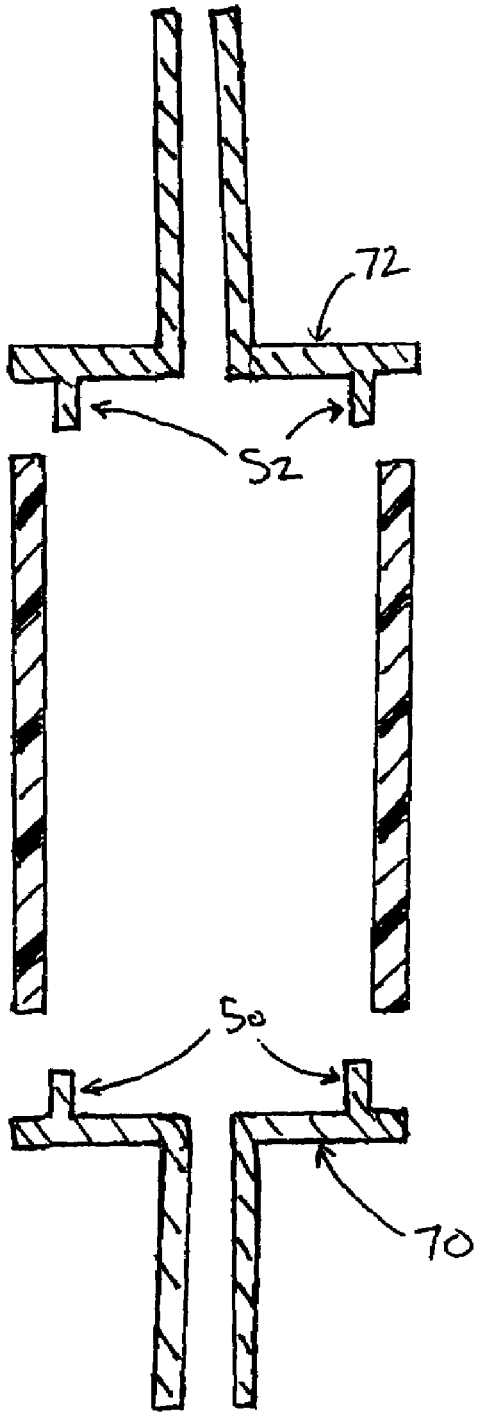
FIG. 5 is a cross-sectional and exploded view of a discharge vessel according to another embodiment of the present invention.
Figure 6:
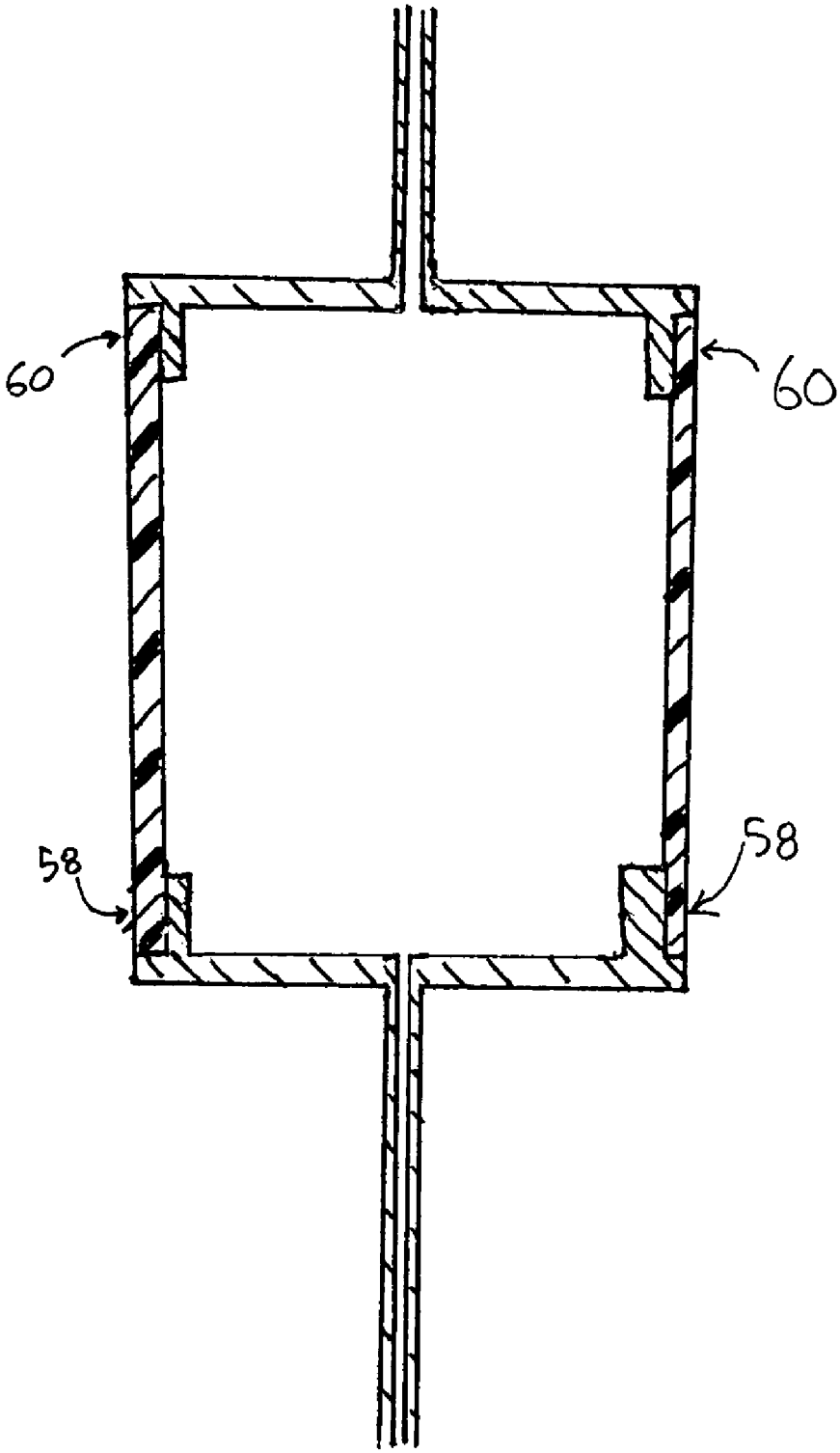
FIG. 6 is a cross-sectional view of the discharge vessel of FIG. 5 in assembled form.

With further reference to FIG. 5, to reduce the risk of fracture during and after the formation of the discharge tube, the end walls 16, 18 or combined end wall/projecting tubes 70, 72 may be provided with strengthening portions 50, 52. The strengthening portions may take the form of an annular widened portion which extends from a top portion of the respective end wall in a direction opposite to the projecting tubes. The strengthening portions 50, 52 are received in the respective ends of the tubular body to create an annular thickened region 58, 60 when the two parts are joined together (FIG. 6).

The discharge tube components are fabricated, for example, by die pressing, injection molding, or extruding a mixture of a ceramic powder and a binder system into a solid body. For die pressing, a mixture of about 95-98% of a ceramic powder and about 2-5% of a binder system is pressed into a solid body. For injection molding, larger quantities of binder are used, typically 40-55% by volume of binder and 60-45% by volume ceramic material.

The ceramic powder may be any material conventionally used in the manufacture of ceramic metal halide discharge tubes. They are preferably formed from a polycrystalline aluminum oxide ceramic, although other polycrystalline ceramic materials capable of withstanding high wall temperatures up to 1700-1900° C. and which are resistant to attack by the, fill materials are also contemplated. The ceramic powder may comprise alumina having a purity of at least 99.98% and a surface area of about 2-10 $m^2/g$. The alumina powder may be doped with magnesia to inhibit grain growth, for example, in an amount equal to 0.03% to 0.2%, preferably, 0.05%, by weight of the alumina. Other ceramic materials which may be used include non-reactive refractory oxides and oxynitrides, such as yttrium oxide, lutecium oxide, and hafnium oxide, and their solid solutions and compounds with alumina, such as yttrium-aluminum-garnet and aluminum oxynitride. Binders which may be used for die pressing, either individually or in combination, include organic polymers, such as polyols, polyvinyl alcohols, vinyl acetates, acrylates, cellulosics, and polyesters. For injection molding, the binder may comprise a wax mixture or a polymer mixture.

For binders which are solid at room temperature, a thermoplastic molding process is preferably used. To carry out thermoplastic molding, sufficient heat and pressure is applied to the ceramic composition to force it to flow to the desired degree depending on the particular thermoplastic molding process employed. The ceramic powder/binder composition is heated to a temperature at which the binder is soft or molten. For most commercial thermoplastic forming techniques, the ceramic composition is heated to make the binder molten at from about 60° C. to about 200° C., shaped under a pressure ranging from about 0.35 $kg/cm^2$ to about 2,100 $kg/cm^2$, depending upon the particular thermoplastic forming technique, and then allowed to cool and harden. For example, in the case of injection molding, the molten ceramic composition is forced into a die to produce the molded product. Specifically, for injection molding, the molten ceramic mixture, preferably at a temperature from about 65° C. to about 90° C. and under a pressure ranging from about 70 $kg/cm^2$ to about 2,100 $kg/cm^2$, is forced into a die where it is allowed to harden and then removed from the die. The die may be cooled to facilitate hardening. A number of thermoplastic molding techniques can be used to produce the present molded body. Representative of such techniques are pressure injection molding, gas-assisted injection molding, extrusion molding, blow molding, compression molding, transfer molding, drawing and rolling.

Other binders, such as aqueous binders, do not need to be heated to form a slurry suitable for molding. For example, in one single piece molding technique, a mold formed from Plaster of Paris is formed in two halves. The mold halves are formed such that when they are mated together, the tubular body portions and projecting tubes are aligned. A slurry formed from a mixture of a ceramic powder (e.g., alumina/magnesia, as described above) and a liquid, such as water, is poured into the mold. The mold is rotated to distribute the slurry over internal surfaces of the mold cavity. Since the Plaster of Paris is absorbent, the water is quickly drawn out of the slurry, leaving a coating of ceramic powder on the internal walls. When dry, the mold halves can be removed leaving the discharge tube ready for further drying, sintering, firing, and other processing.

Subsequent to die pressing, injection molding, single piece molding, or other forming technique, the binder is removed from the "green" part. For example, for die pressed parts, the binder is removed by solvent leaching with hexane, and/or by thermal pyrolysis to form a bisque-fired part. The thermal pyrolysis may be conducted, for example, by heating the green part in air from room temperature to a maximum temperature of about 900-1100° C. over 4-8 hours, preferably, to a temperature of about 200-400° C., and then holding the maximum temperature for 1-5 hours, and then cooling the part. After the thermal pyrolysis, the porosity of the bisque-fired part is about 40-50%. Pyrolysis generally oxidizes and burns out the volatile components.

For injection-molded parts, the binder is removed from the molded part, typically by thermal treatment. The thermal treatment may be conducted by heating the molded part in air or a controlled environment, e.g., vacuum, nitrogen, or rare gas, to a maximum temperature. For example, the temperature may be slowly increased by about 2-3° C. per hour from room temperature to a temperature of about 160° C. Next, the-temperature is increased by about 100° C. per hour to a maximum temperature of about 900-1100° C. Finally, the temperature is held at 900-1100° C. for about 1-5 hours. The part is subsequently cooled. After the thermal treatment step, the porosity is about 40-50%.

The bisque-fired part is then machined, where needed. For example, a small bore or bores may be drilled along the axis of a solid cylinder to provide the bore(s) of the leg portion. The outer portion of the solid cylinder may be machined away, for example with a lathe, to form the outer surface of the leg portion. The machined parts are typically assembled prior to sintering to allow the sintering step to bond the parts together: The densities of the bisque fired parts used to form the barrel and the end plugs is preferably selected to achieve different degrees of shrinkage during the sintering step. The different densities may be achieved by using ceramic powders of different surface areas. Finer powders produce lower densities than coarser ones. The barrel is preferably of lower density than the end plug so that it shrinks more.

For discharge tubes formed by a single piece molding technique, as described above, there are not the same density concerns discussed above, since the green part is a single component, rather than separate components which are joined in the sintering stage. Further, if the size and shape of the mold is carefully selected, machining of the bisque-fired part may not be necessary, since the mold can be used to define the outer surface, including filets and the internal bores. It will be appreciated, however, that this method yields a barrel of generally uniform wall thickness. The thickened portions 50, 52 shown in FIG. 6 are not readily formed by this method. However, because of the unitary construction, the transition from the barrel to the end wall is naturally stronger than an equivalent discharge tube formed from separate components and tends naturally to have a curved profile, which reduces stresses.

The sintering step may be carried out by heating the bisque-fired parts or discharge tube in hydrogen having a dew point of about 10-15° C. or in an inert atmosphere. Argon gas provides a suitable inert atmosphere, although other inert gases are also contemplated. Typically, the temperature is increased from room temperature to about 1300° C. over a two hour period. Next, the temperature is held at about 1300° C. for about two hours. The temperature is then increased by about 100° C. per hour up to a maximum temperature of about 1850-1900° C., and held at that temperature for about three to five hours. Finally, the temperature is decreased to room temperature over about two hours. The inclusion of magnesia in the ceramic powder typically inhibits the grain size from growing larger than 75 microns. The resulting ceramic material comprises a densely sintered, polycrystalline alumina.

Pressures above atmospheric may also be applied during the sintering step. The bisque-fired ceramic is converted, during sintering, from an opaque material to a translucent polycrystalline aluminum oxide. The sintering step also strengthens the joints between the components of the discharge tube. Other sintering methods are also contemplated.

The sinterable ceramic powder preferably has an average particle size of from 0.01-1000 μm, more preferably, below about 50 μm. For discharge tube applications, the average size of the ceramic powder preferably ranges up to about 10 μm and depends largely on the particular densification technique employed, i.e., larger particle sizes can be used in reaction bonding whereas smaller particle sizes would be used in sintering a compact thereof. Preferably, however, the ceramic powder has an average particle size which is submicron and most preferably, it has an average particle size ranging from about 0.05 microns up to about 1 micron.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A metal halide lamp comprising:

a discharge vessel;

an outer lamp envelope enclosing said discharge vessel;

a pair of electrodes sealed in opposing ends of said discharge vessel; and an ionizable fill contained in said discharge vessel;

wherein said ionizable fill comprises mercury in a concentration of from 0.11 to 0.20 mg/mm$^3$; and said lamp has a power of 20 watts; and said lamp operates at 150-170 Hz square wave.

2. The metal halide lamp of claim 1, wherein said mercury concentration is about 0.12 mg/mm$^3$.

3. The metal halide lamp of claim 1, wherein said discharge vessel operates at an internal pressure of from about 80 to 170 atmospheres at a discharge tube temperature of 2000 K.

4. The metal halide lamp of claim 1, where said discharge vessel operates at 120 volts.

5. The metal halide lamp of claim 1, wherein an arc gap between the electrodes is 2.0 to 3.0 mm.

6. The metal halide lamp of claim 1, wherein said discharge vessel comprises aluminum oxide.

7. A discharge vessel comprising:

a tubular body of a translucent ceramic material;

first and second end walls closing ends of said tubular body to define a discharge space;

first and second projecting tubes attached respectively to said first and second end walls and extending away from said tubular body;

an ionizable fill contained in the tubular body for creating a discharge, said ionizable fill comprising mercury in a concentration of from 0.11 mg/mm$^3$ to 0.20 mg/mm$^3$;

said tubular body contains metal halide;

first and second electrodes supported in the chamber;

said first electrode extending through and sealed in said first projection tube, said second main electrode extending through and sealed in said second projection tube; and said vessel operating at 20 watts.

said vessel operating at 150-170 Hz square wave.

8. The discharge vessel of claim 7, wherein each of the end walls is formed with an annular portion which is joined to the tubular body during formation of the discharge vessel to provide an annular widened portion at each end of the discharge space.

9. The discharge vessel of claim 7, wherein said first and second electrodes have a spacing of 2.0 to 3.0 mm therebetween.

10. The discharge vessel of claim 7, wherein said discharge vessel has an internal pressure of from 80 to 170 atmospheres at a temperature of 2000 K.

11. The discharge vessel of claim 7, wherein said vessel has a potential of about 120 volts applied across the electrodes.

12. The discharge vessel of claim 7 having a length of 4.8 to 5.3 mm.

13. The discharge vessel of claim 7 wherein said fill comprises mercury in a total amount of from 4.2 to 8.2 mg.

14. The discharge vessel of claim 7, wherein the body is formed from a polycrystalline alumina.

15. A lighting device comprising a metal halide lamp and a power supply, wherein said metal halide lamp comprises:

a discharge vessel;

an outer lamp envelope enclosing said discharge vessel;

a pair of electrodes sealed in opposing ends of said discharge vessel; and an ionizable fill contained in said discharge vessel; wherein said ionizable fill comprises mercury in a concentration of from 0.11 to 0.20 mg/mm$^3$; and said lamp has a power of 20 watts; and wherein said power supply supplies a 150-170 Hz square wave.

16. A lighting device comprising a discharge vessel and a power supply, wherein said discharge vessel comprises:

a tubular body of a translucent ceramic material;

first and second end walls closing ends of said tubular body to define a discharge space;

first and second projecting tubes attached respectively to said first and second end walls and extending away from said tubular body;

an ionizable fill contained in the tubular body for creating a discharge, said ionizable fill comprising mercury in a concentration of from 0.11 mg/mm$^3$ to 0.20mg/mm$^3$;

said tubular body contains metal halide;

first and second electrodes supported in the chamber;

said first electrode extending through and sealed in said first projection tube, said second main electrode extending through and sealed in said second projection tube;

said vessel operating at 20 watts; and wherein said power supply supplies a 150-170 Hz square wave.

* * * * *